US011791598B2

(12) United States Patent
Henrici et al.

(10) Patent No.: US 11,791,598 B2
(45) Date of Patent: Oct. 17, 2023

(54) LAMP SOCKET WITH RETAINING CLIP FOR LAMP

(71) Applicant: BJB GmbH & Co. KG, Arnsberg (DE)

(72) Inventors: Philipp Henrici, Arnsberg (DE); Olaf Baumeister, Sundern (DE); Mark Weber, Arnsberg (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 17/741,873

(22) Filed: May 11, 2022

(65) Prior Publication Data

US 2022/0376450 A1 Nov. 24, 2022

(30) Foreign Application Priority Data

May 18, 2021 (DE) ..... 102021112799.8

(51) Int. Cl.
*H01R 33/97* (2006.01)
*H01K 1/42* (2006.01)
*H01R 33/06* (2006.01)

(52) U.S. Cl.
CPC ..... *H01R 33/97* (2013.01); *H01K 1/42* (2013.01); *H01R 33/06* (2013.01); *H01R 2201/00* (2013.01)

(58) Field of Classification Search
CPC .... H01R 33/97; H01R 33/973; H01R 33/975; H01R 33/9756; H01R 33/06; H01R 2201/00; H01K 1/42
See application file for complete search history.

(56) References Cited

U.S. PATENT DOCUMENTS 5,465,025 A * 11/1995 Hendrickson ..... H01R 33/94 313/50
7,119,484 B2 * 10/2006 Damm ..... H01J 5/52 313/318.01
7,422,341 B2 * 9/2008 Henrici ..... F24C 15/008 362/649
8,485,713 B2 * 7/2013 Atalay ..... F24C 15/008 362/651

(Continued)

FOREIGN PATENT DOCUMENTS

DE 112009002252 B4 6/2018
DE 202021102682 U1 5/2021
DE 202021102683 U1 5/2021

(Continued)

*Primary Examiner* — Oscar C Jimenez
*Assistant Examiner* — Paul D Baillargeon
(74) *Attorney, Agent, or Firm* — Von Rohrscheidt Patents

(57) ABSTRACT

A lamp socket for a cooking appliance light, the lamp socket including a socket body; a base receiver configured to receive a lamp base of a lamp and formed at a top side of the socket body; connection contacts for external connection conductors of a voltage supply, the connection contacts arranged at a bottom side of the socket body; an attachment ring configured to retain the lamp base in the base receiver; two retaining arms integrally formed at the attachment ring; two spring arms respectively arranged at the two retaining arms and forming a receiving gap for the lamp base between each other and respectively including a free spring arm end and a connected spring arm end respectively connected at each of the two retaining arms, wherein the two spring arms are arranged in the base receiver.

8 Claims, 9 Drawing Sheets

(56) References Cited

U.S. PATENT DOCUMENTS

2005/0218774 A1 10/2005 Bhagwat

FOREIGN PATENT DOCUMENTS

| | | | |
|---|---|---|---|
| DE | 202021102684 | U1 | 5/2021 |
| EP | 1435636 | A2 | 7/2004 |
| EP | 1811227 | | 7/2007 |
| EP | 1811227 | A1 | 7/2007 |
| WO | WO002010023682 | A1 | 3/2010 |

* cited by examiner

LAMP SOCKET WITH RETAINING CLIP FOR LAMP

RELATED APPLICATIONS

This application claims priority from and incorporates by reference German Patent Application DE 10 2021 112 799.8 filed on May 18, 2021.

FIELD OF THE INVENTION

The invention relates to a lamp socket, in particular for cooking appliance lights, in particular a G9 lamp socket.

BACKGROUND OF THE INVENTION

Generic lamp sockets are known e.g. from EP 1 811 227 and widely used in particular for illuminating cooking appliance cavities.

Lamp sockets of this generic type and are still widely used in cooking appliance lights in spite of the advances of LED technology. This is owed in part to a rather limited temperature sensitivity of the illuminant and to established and economical components and fabrication techniques.

However, there is a long felt need in the industry to further simplify and improve fabrication of generic lamp sockets.

BRIEF SUMMARY OF THE INVENTION

The object is achieved by a lamp socket for a cooking appliance light, the lamp socket including a socket body; a base receiver configured to receive a lamp base of a lamp and formed at a top side of the socket body; connection contacts for external connection conductors of a voltage supply, the connection contacts arranged at a bottom side of the socket body; an attachment ring configured to retain the lamp base in the base receiver; two retaining arms integrally formed at the attachment ring; two spring arms respectively arranged at the two retaining arms and forming a receiving gap for the lamp base between each other and respectively including a free spring arm end and a connected spring arm end respectively connected at each of the two retaining arms, wherein the two spring arms are arranged in the base receiver, wherein the two retaining arms are arranged proximal to the top side of the socket body, and wherein free ends of the spring arms are oriented towards the bottom side of the socket body and arranged in the base receiver.

The essential advantage of the invention is that the retaining clip that was inserted into the socket body from below in the generic lamp sockets is now inserted into the socket body from the top side of the socket body.

This frees up installation space at the bottom side of the socket body wherein the installation space is otherwise rather limited at this location due to the inserted connection contacts. This provides additional design options at the bottom side of the socket body which can be used for example to optimize socket ventilation of the lamp inserted into the socket.

In an advantageous embodiment the socket body forms an attachment contour for the retaining arm that fixes the spring arm at a top side of the socket body, in particular when each spring arm is connected at a retaining arm and the attachment contour is a retaining slot that is fabricated on the top side and runs towards the bottom side of the socket body and the retaining slot is arranged adjacent to the base receiver.

In this embodiment the invention proposes to fix each spring arm in the socket body separately wherein the retaining arms of each spring arm are to be fixed in the attachment contour by friction locking, however, advantageously by positive form locking.

In a particularly advantageous embodiment, the retaining clamp is part of an attachment ring that is fixed at the socket body and that envelops the base receiver. Attachment rings of this generic type are well known in the art. They are used for fixing the lamp socket in a cut out of a cooking cavity wall in combination with a mounting flange. Thus, the cooking appliance wall is received between the mounting flange and a reaction bearing, typically an interlocking spring. When the retaining clip is part of the attachment ring this reduces a number of components to be mounted. This reduces fabrication costs and simplifies fabrication methods.

In an advantageous embodiment the spring arms are only connected at the attachment ring during the mounting process and separated in an additional mounting step by a suitable tool from the attachment ring in order to prevent an electrically conductive connection between the spring arms of the retaining clip and the attachment ring. During a disengagement process the tool can anchor the retaining arms by friction locking or positive form locking in corresponding attachment contours of the socket body e.g. by material deformation.

However, it is also conceivable that the spring arms connected at the retaining ring are configured with retaining arms which are anchored in attachment contours at the socket body by positive form locking or friction locking during insertion of the attachment ring. In order to perform a separation material bridges between the spring arms and/or the support arms and the attachment ring are cut.

Electrical safety can be provided in a supplemental or alternative manner by providing the attachment ring with a ground conductor connection.

In an advantageous embodiment the socket body forms a lamp receiver that is enveloped by a wall at a top side of the socket body wherein a base of the lamp receiver forms the base receiver, in particular when the wall forms fixing cavities at an inner surface of the wall wherein the fixing cavities are engaged by fixing lugs of the attachment ring.

The attachment ring can be fixed in a particularly simple permanent and force stable manner at the socket body using the fixing cavities that are engaged by the fixing lugs of the attachment ring.

In an advantageous embodiment the wall includes interlocking cut outs which are penetrated by interlocking lobes of the attachment ring, wherein the wall forms a mounting flange, wherein a cooking cavity wall is arrangeable between the interlocking lobes and the mounting flange in order to mount the socket.

An additional reduction of a number of components is achieved when the attachment ring includes at least one retaining device for a light glass, wherein the retaining device is a bayonet protrusion.

BRIEF DESCRIPTION OF THE DRAWINGS

Further advantages of the invention and an even better understanding thereof can be derived from the subsequent description of the embodiment based on drawing figures, wherein.

DETAILED DESCRIPTION OF THE INVENTION

Figure 1:
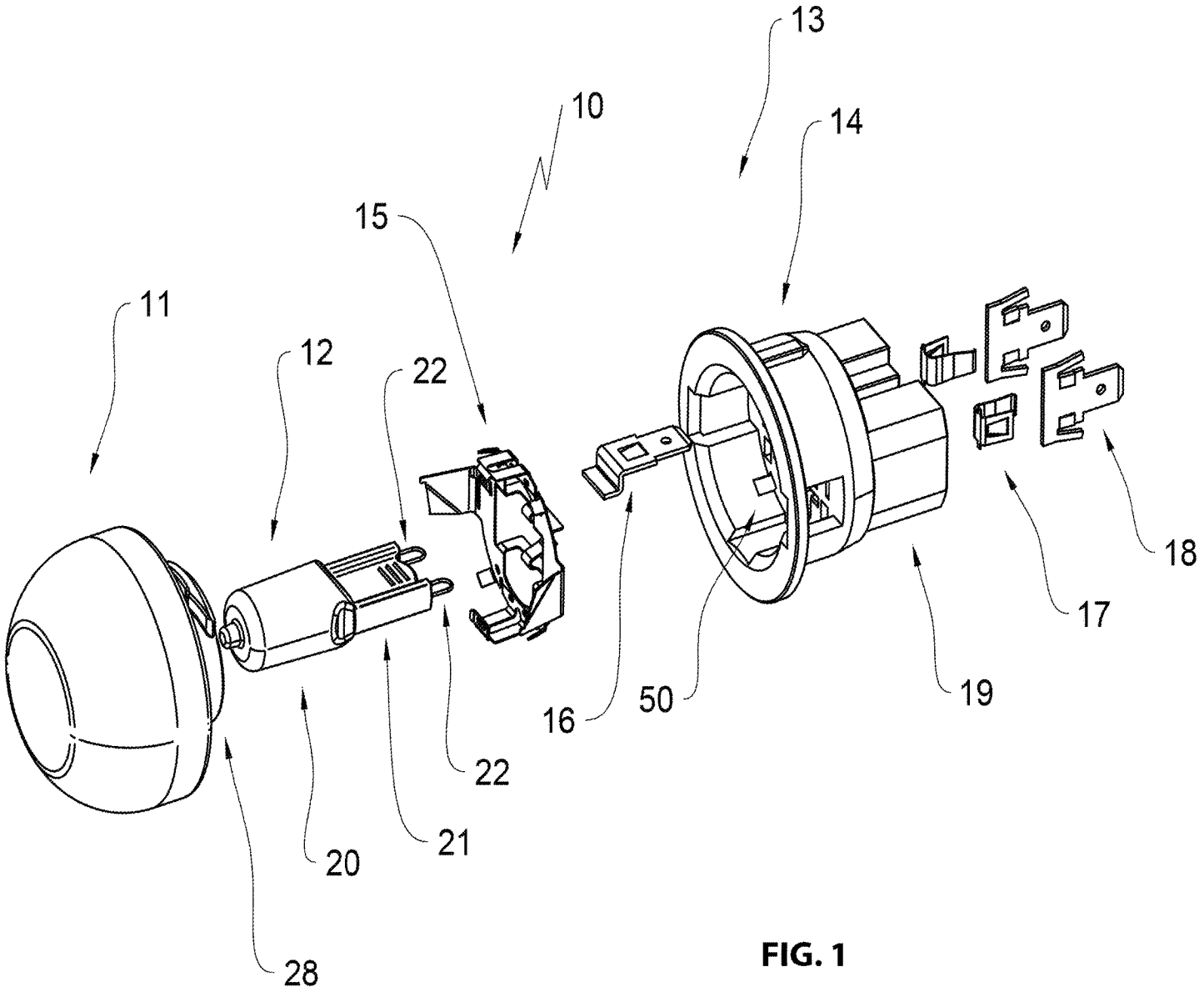
FIG. 1 illustrates a cooking appliance lamp including the lamp socket according to the invention.

The drawing figures show a cooking appliance light overall designated with reference numeral 10.

FIG. 1 illustrates the cooking appliance light 10 in an exploded view including a light glass 11, a lamp 12 configured herein as a G9 lamp and a lamp socket overall designated with reference numeral 13.

The lamp socket 13 is formed by a socket body 14 that supports an attachment ring 15, a ground conductor connection 16 and that receives socket contacts 17 and connection contacts 18.

Thus, the attachment ring 15 and the ground conductor connection are arranged on the top side of the socket body 14. The socket contacts 17 and the connection contacts 18 are received in studs 19 of a bottom side of the socket body 14.

The lamp 12 includes a lamp cylinder 20 and an adjoining lamp base 21 that supports two base contacts 22.

Figure 5:
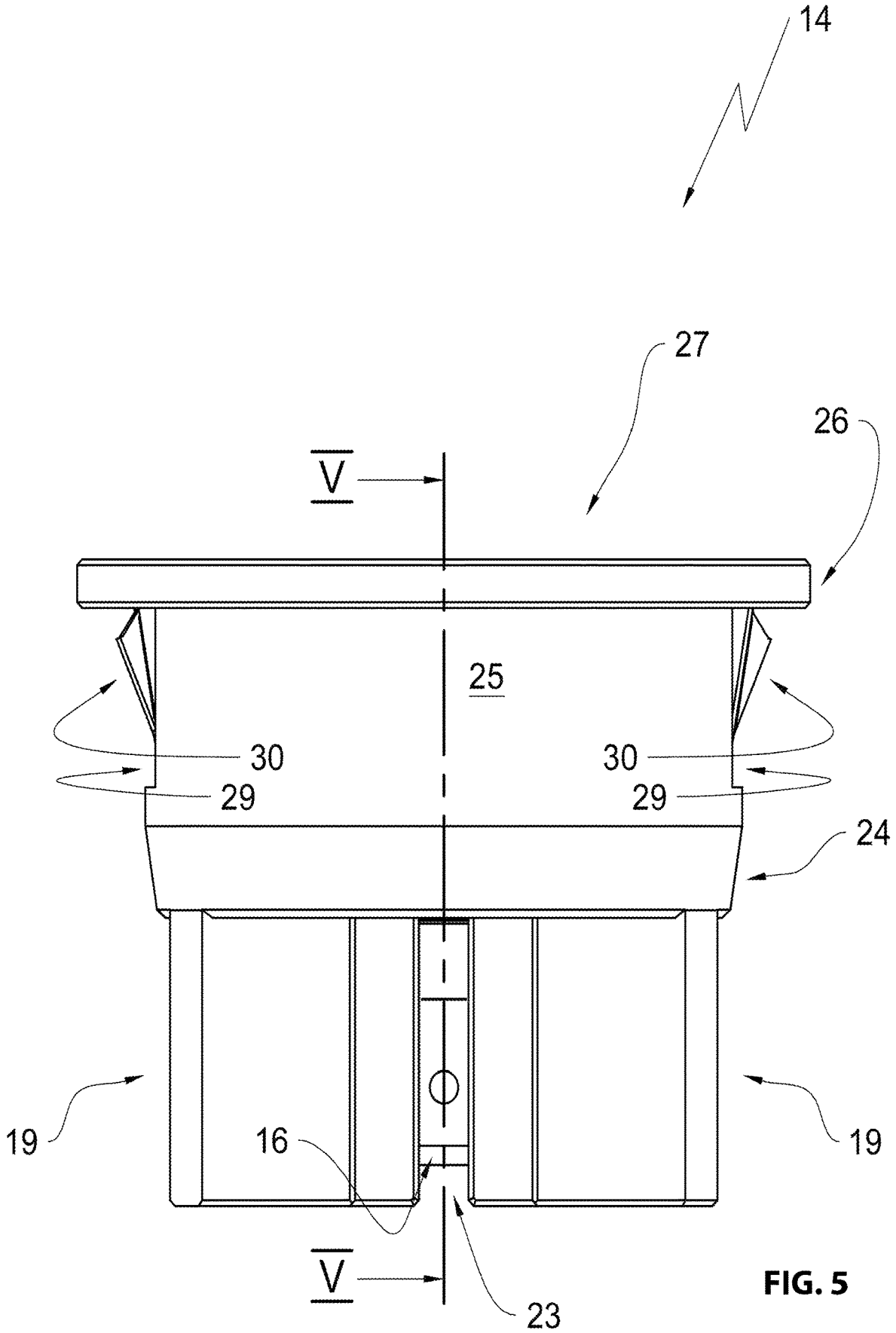
FIG. 5 illustrates a side view of the socket according to the invention.
Figure 8:
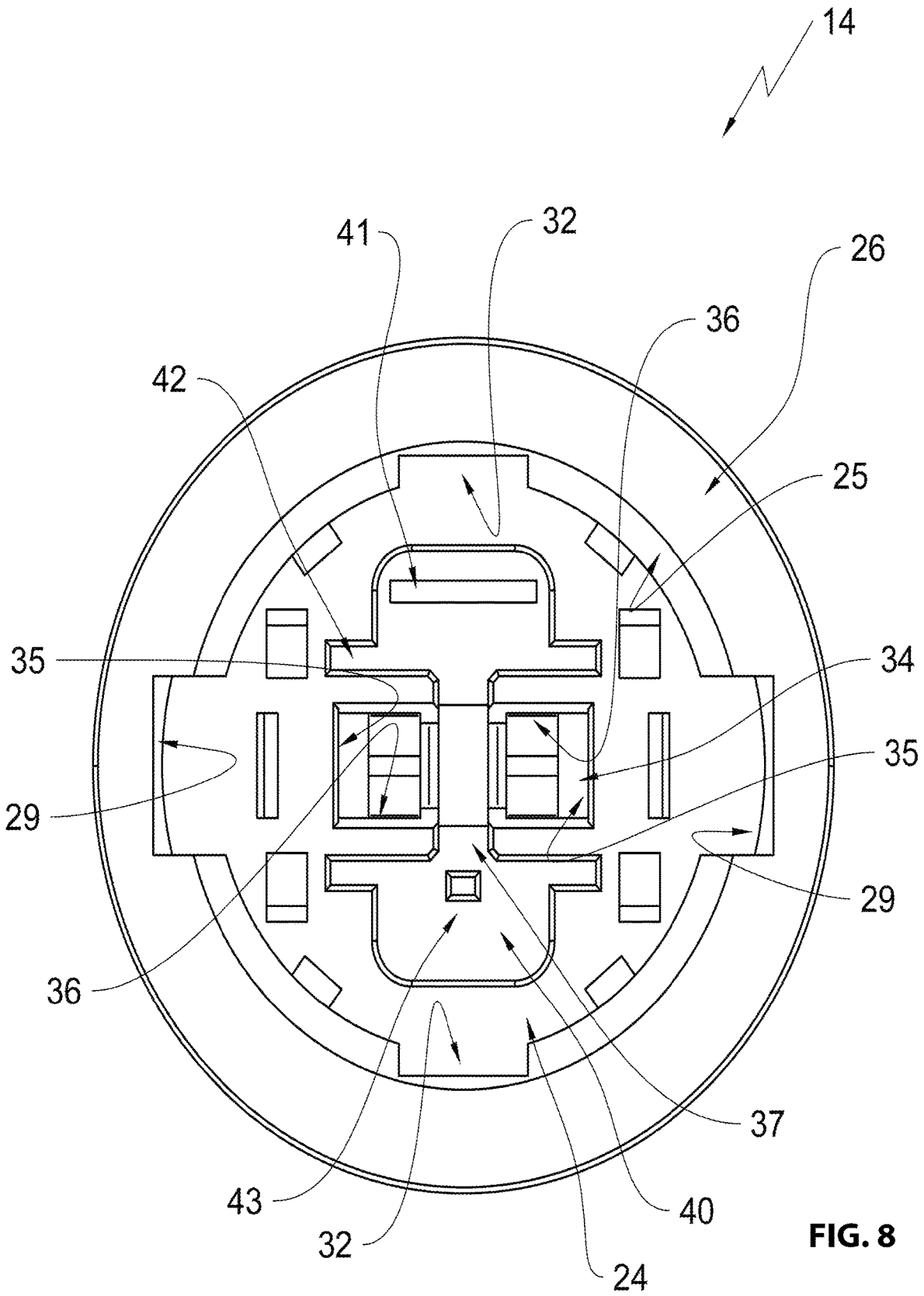
FIG. 8 illustrates the lamp socket according to the invention in a top view.
Figure 9:
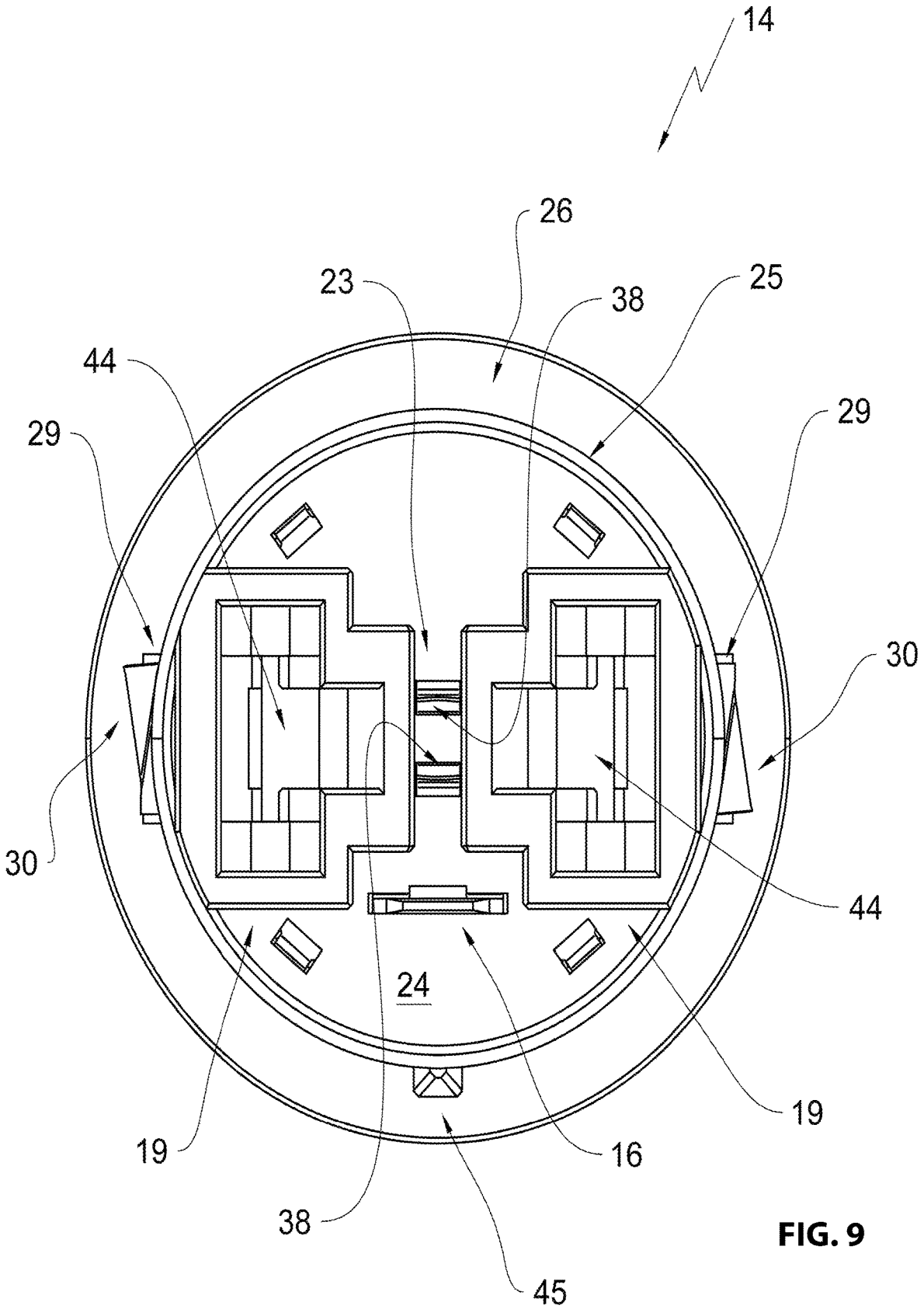
FIG. 9 illustrates the lamp socket according to the invention in a bottom view.

FIGS. 5, 8 and 9 show the socket body 14. FIG. 5 shows a side view, FIG. 8 shows a top view and FIG. 9 shows a bottom view of the socket body 14.

It is evident from FIG. 5 that the socket body 14 includes two studs 19 on a bottom side. A ventilation gap 23 is formed between the two studs 19 and facilitates cooling the lamp socket 21 inserted into the socket body 14. The ground conductor connection 16 is arranged behind the studs 19 with reference to the drawing plane of FIG. 5 and inserted into the socket body 14 from a top side.

The socket body 14 forms a socket base 24 from which the studs 19 extend towards the bottom side and on which an annular wall is connected in the opposite direction, wherein the annular wall supports a mounting flange 26 at an upper end.

The annular wall 25 vertically envelops a receiving cavity 27 between the mounting flange 26 and the socket base 24, wherein the attachment ring and the lamp 12 are inserted into the receiving cavity 27 and wherein the receiving cavity receives the light collar 28 that fixes the light glass 11 at the socket body 14.

FIG. 1 shows in combination with FIG. 5 that the annular wall 25 includes interlocking spring cut outs 29 in two sections that are diametrically opposed to each other wherein interlocking springs 30 of the attachment ring 15 exit from the interlocking spring cut outs 29.

FIG. 8 shows a top view of the socket body 14, thus a view of the top side of the socket base 24. It is evident from FIG. 8, that the mounting flange 26 envelops an insertion opening 31 through which the receiving cavity 27 is accessible, whereas the socket base 24 defines the receiving cavity in a downward direction. The annular wall 25 of the socket body 14 includes two diametrically opposed grooves 32 in addition to the interlocking spring cut outs 29 at angular increments that are circumferentially offset by 90°, wherein the attachment arms 33 that support the light glass 11 are inserted into the diametrically opposed grooves 32.

A base receiver 34 is configured in the socket base 24 and extends like a dead hole towards the bottom of the socket, wherein the lamp base 21 of the lamp 12 is insertable into the base receiver. The base receiver 34 has an approximately rectangular cross section and is enveloped by two opposite face walls 35 and by two opposite transversal walls 36. The transversal walls 36 respectively include a spring cut out 37 that is approximately centrally arranged in each transversal wall 36 and that passes a respective spring arm 38 of a retaining clip 39 through.

The respective spring cut out 37 transitions into a support bay 40. The support bay 40 includes a ground conductor receiver 41 through which the ground conductor connection 16 is inserted and in which the ground conductor connection 16 is retained. A respective slot receiver 42 that is parallel to the transversal wall forms part of each support bay 40. One of the support bays 40 includes a stabilization pin 43 that protrudes in a direction towards the top side.

FIG. 9 illustrates a bottom view of the socket body 14 showing the studs 19 that protrude from the bottom side of the socket base 24 in a direction towards the viewer. Each stud 19 is provided with a contact cavity 44 in which connection and socket contacts 17, 18 are arranged.

This view also shows the ventilation gap 23 extending between the studs 19.

FIG. 9 illustrates in particular that the interlocking springs 30 extend outward through the interlocking spring cut outs 29 and protrude in outward direction relative to the annular wall 25 so that they are arranged below the mounting flange 26. Last, not least FIG. 9 shows a coding rib 45 that is arranged at an outer circumference of the annular wall 25 and that provides a defined orientation of the socket body 14 in a cooking cavity wall. The spring arms 38 of the attachment ring 15 that are inserted into the socket body 14 extend with their free ends within the base receiver 34 towards the bottom side of the socket body 14, thus towards the viewer of FIG. 9 and are visible in the area of the ventilation gap 23 within the base receivers 34.

Figure 2:
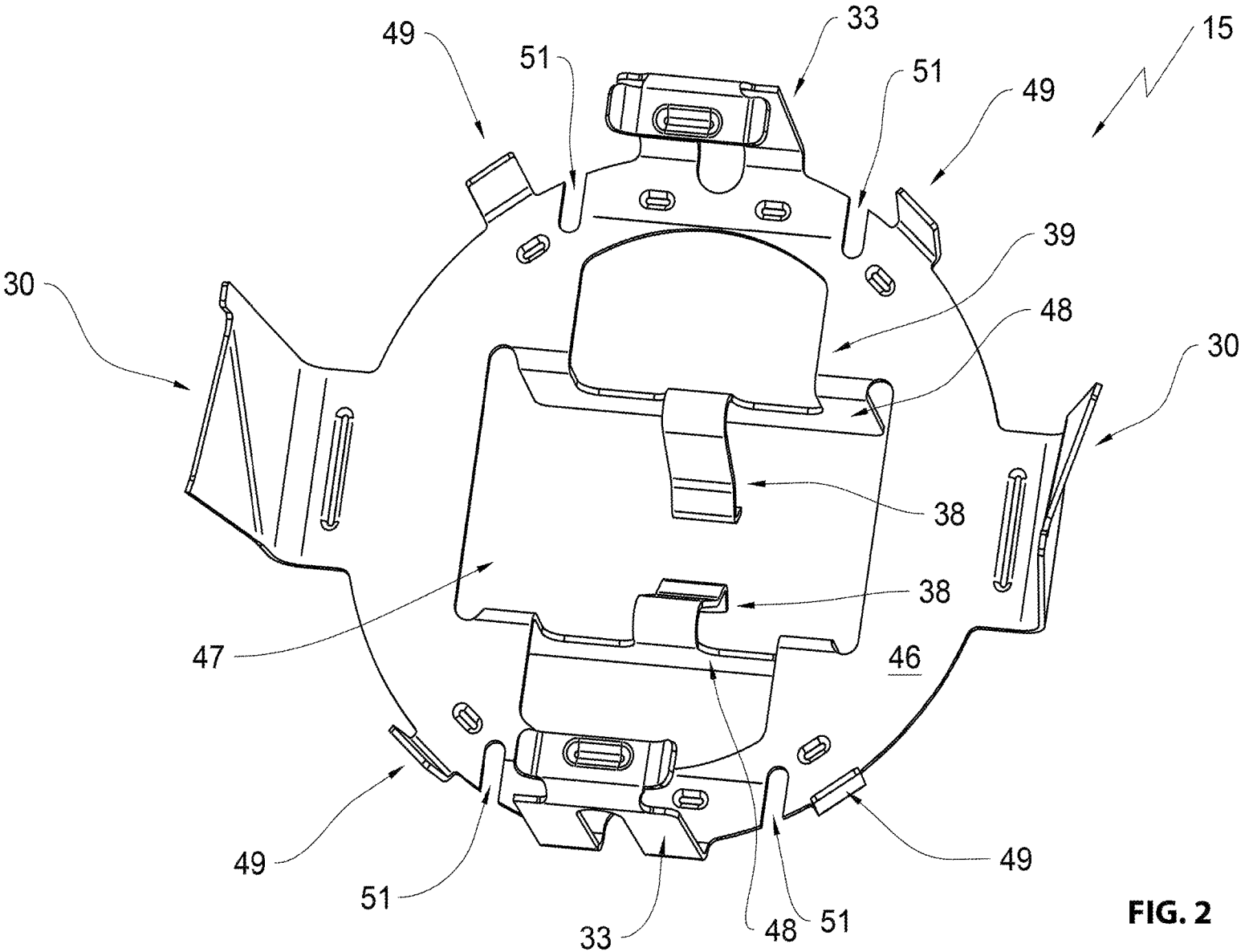
FIG. 2 illustrates an attachment ring of the lamp socket illustrated in FIG. 1 in a perspective view.
Figure 3:
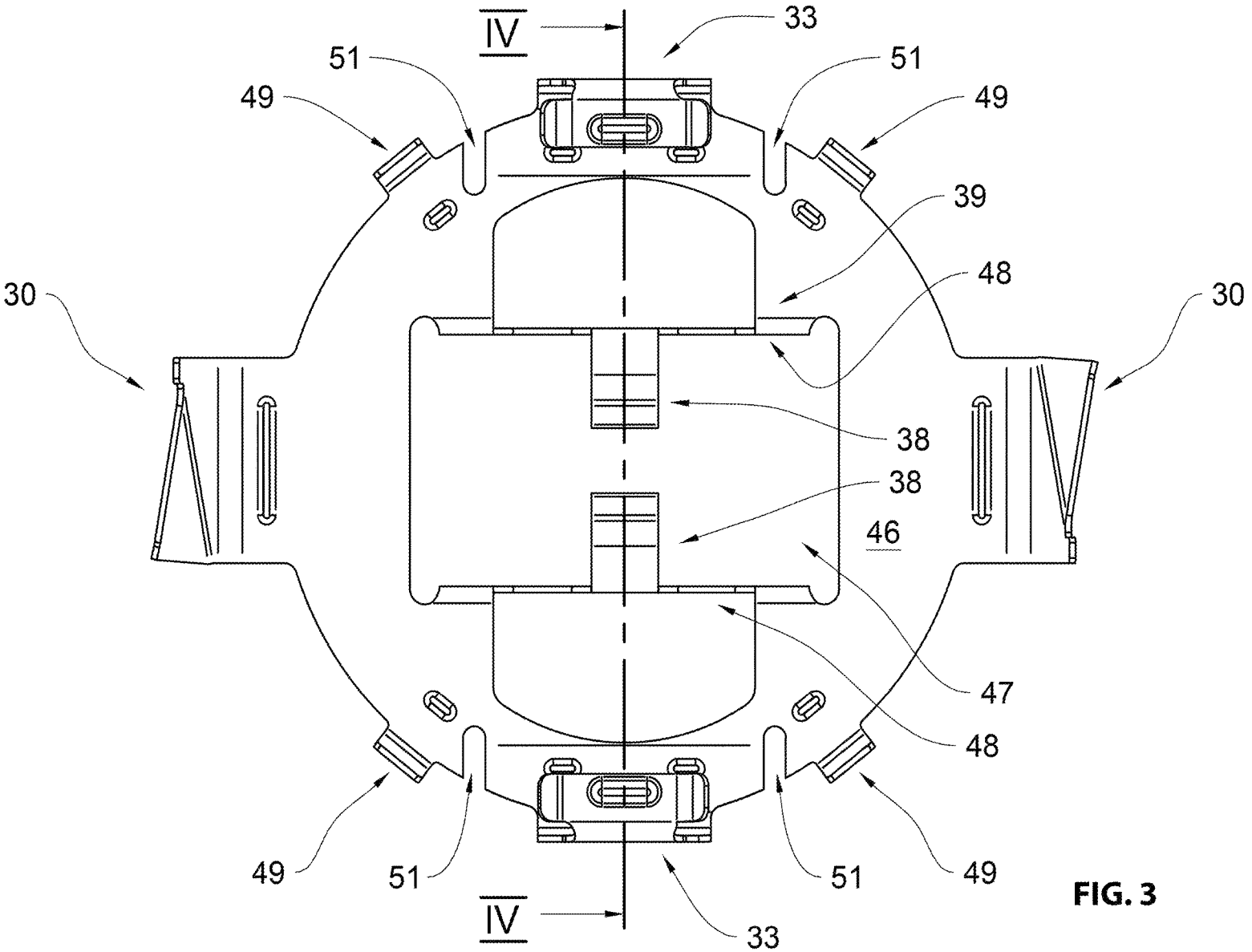
FIG. 3 illustrates the attachment ring according to FIG. 2 in a top view.
Figure 4:
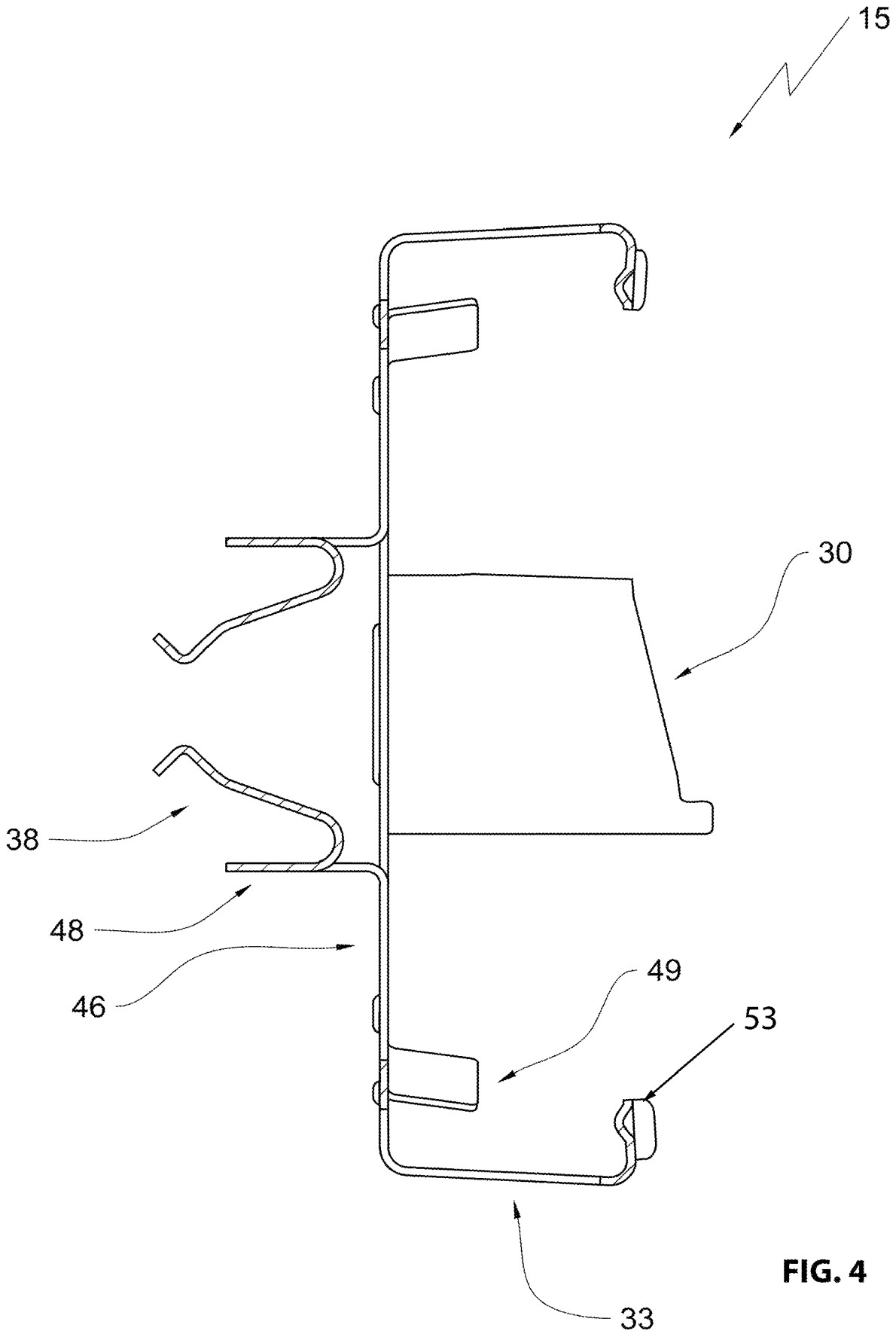
FIG. 4 illustrates the attachment ring according to FIG. 3 in a sectional view according to sectional line IV-IV in FIG. 3.

FIGS. 2-4 show different views of the attachment ring 15. FIG. 2 shows a perspective view of a top side of the attachment ring. FIG. 3 shows a top view of the attachment ring 15, whereas FIG. 4 shows a sectional view according to sectional line IV-IV in FIG. 3.

The attachment ring 15 includes a base plate 46 that is oriented towards the socket base 24, and supported thereon with its bottom side that is oriented away from the viewer in FIGS. 2 and 3. The base plate 46 includes a center cut out 47 that is aligned with the base receiver 34 when correctly mounted in the socket body 14 so that the lamp base 21 is insertable through the cut out 46 into the base receiver 34.

In the instant embodiment of the invention the retaining clip 39 is integrated in the attachment ring 15 so that the base plate 46 performs the function of the retaining arm where the spring arms 38 of the retaining clip 39 are connected.

Each spring arm 38 is connected with a stabilization bar 48 that is bent away from the base plate 46 in a direction towards a bottom side of the socket body 14 and oriented parallel to a respectively adjacent transversal wall 36 of the base receiver 34.

The interlocking springs 30 of the attachment ring 15 and the attachment arms 33 for supporting the light glass 11 are respectively formed at an outer circumference of the base plate 46. Additionally, the outer edge of the attachment ring 15 respectively includes fixing lugs 49 on a right side and on a left side of the attachment arm 33. The fixing lugs correspond to respective fixing cavities 50 that are fabricated at an inner circumference into the annular wall 25 of the attachment ring 15 as evident from FIG. 1. Elasticity cuts 51 are respectively introduced into the base plate 46 between a fixing lug 49 and the adjacent attachment arm 33 in order to increase the spring travel of the attachment arm 33 which has advantages with respect to attaching the light glass 11.

It is evident from the sectional view according to FIG. 4 that the spring arms 38 extend from the base plate 46 of the attachment ring 15 in a direction towards a bottom of the socket body and the stabilization bars 38 are also formed from the base plate 46 in a direction towards the bottom side of the socket body 14

To the contrary the interlocking springs 30 and the retaining arms 33 and the fixing lugs 49 are oriented in the opposite direction and respectively also originate from the base plate 46.

Figure 6:
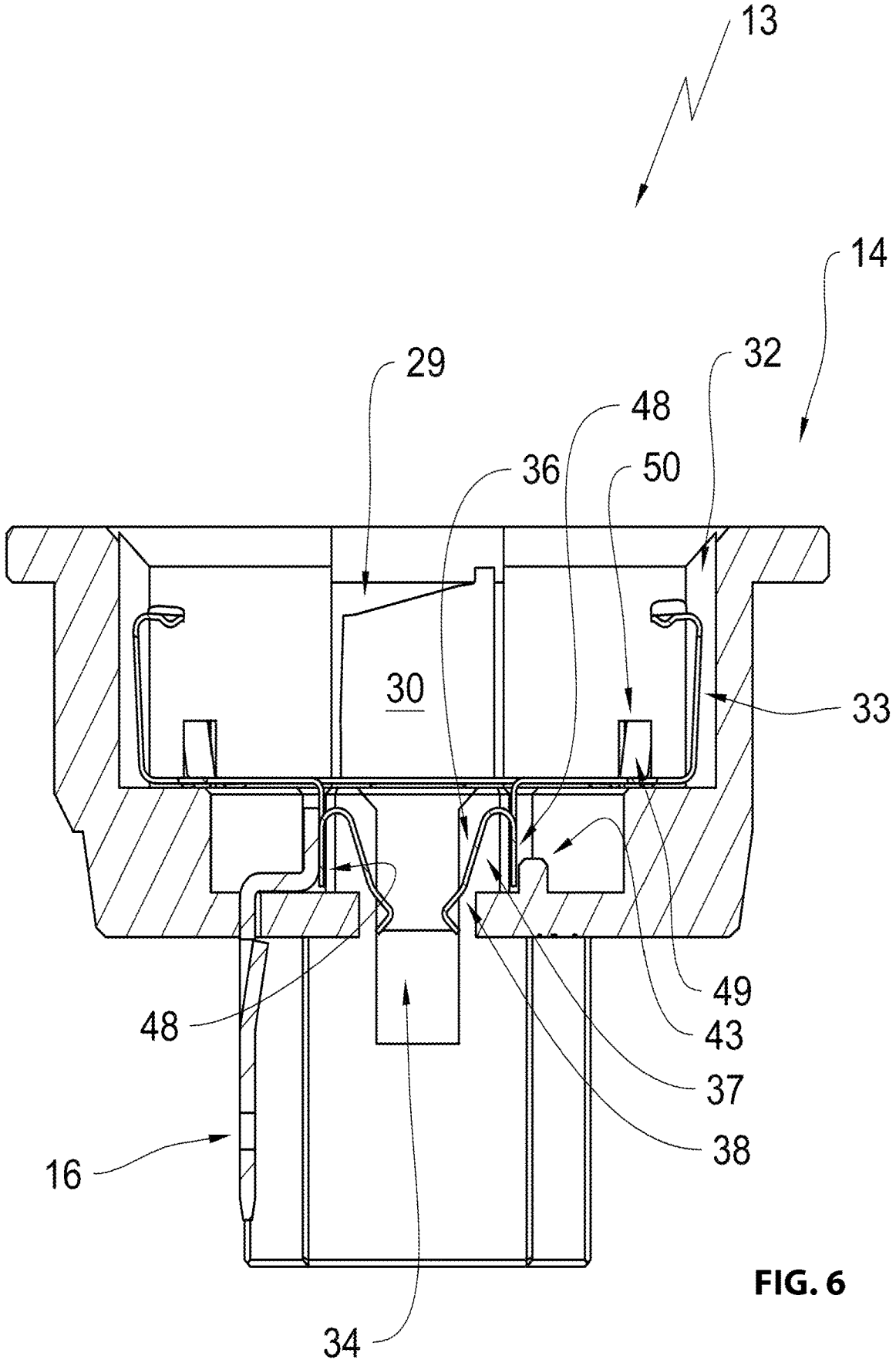
FIG. 6 illustrates a sectional view of the lamp socket according to sectional line VI-VI in FIG. 5.
Figure 7:
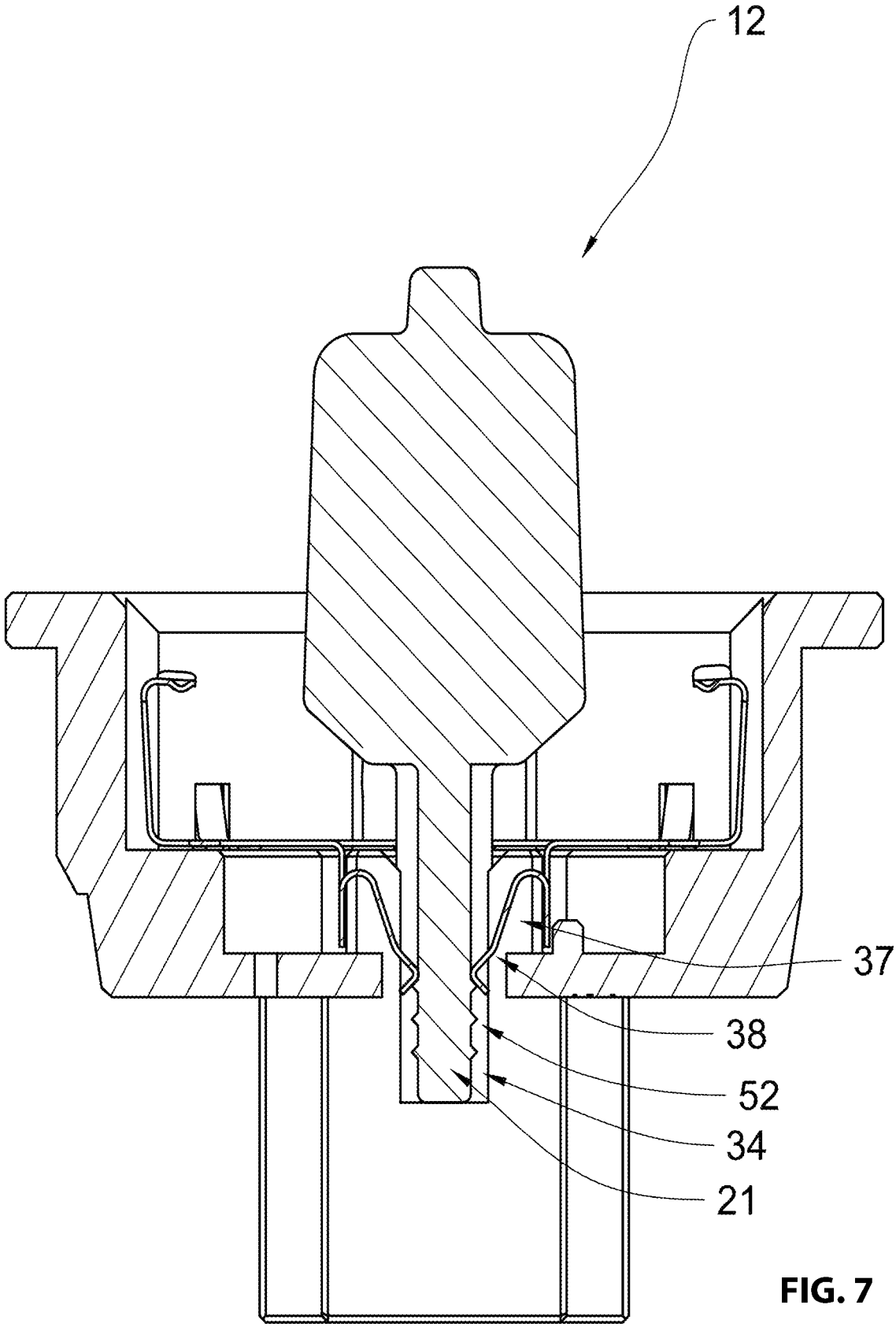
FIG. 7 illustrates the representation according to FIG. 6 with the lamp inserted.

FIGS. 6 and 7 are sectional views of the socket body 14 according to sectional line VI-VI in FIG. 5 and show the attachment ring 15 introduced into the receiving cavity 27 of the socket body 14, in FIG. 7 the lamp 12 is added.

The attachment ring 15 is inserted into the receiving cavity 27 of the socket body 14 from a top side of the socket wherein the attachment arms 33 are aligned with the grooves 32 (FIG. 8) and the interlocking springs 30 are aligned with the interlocking spring cut outs 29 (FIG. 8). While the attachment arms 33 only engage the grooves 32 through friction locking the interlocking springs 30 reach through the respectively associated interlocking spring cut out 29 and thus support a form locking fixing of the attachment ring 15 in the socket body 14. The actual attachment of the attachment ring 15, however, is performed by the cooperation of the fixing lugs 49 with the fixing cavities 50, that are engaged by the fixing lugs 49 and thus provide a positive form locking support of the attachment ring 15 in the socket body 14. The spring arms 38 reach through the respective spring cut out 37 of each transversal wall 36 into the base receiver 34 and are oriented with the respective free spring arm end in a direction towards the bottom side of the socket body 14 or the bottom side of the lamp socket 13.

The stabilization bars 48 at which the spring arms 38 are attached are arranged in the respectively associated slot receiver (FIG. 8) wherein the right stabilization bar 48 with respect to the viewing plane of FIGS. 6 and 7 is supported at the stabilization pin 43. At the left stabilization bar 48 a stabilization pin 43 was omitted since the left stabilization bar 48 is supported at the ground conductor connection 16 in the instant embodiment, wherein the ground conductor connection performs the function of the stabilization pin 43.

The lamp 12 additionally shown in FIG. 7, shows the effect of the retaining clip 39 with its spring arms 38. The lamp base 21 inserted into the base receiver 34 spreads the spring arms outward so that the spring arms due to their reset elasticity apply a force against the socket and engage socket ribs 52 formed at the socket by reaching behind the socket ribs 52.

This protects the lamp 12 against falling out. FIG. 7 furthermore emphasizes the function of the stabilization pins 43 and of the stabilization bar 48. The outward oriented spreading forces of the lamp socket 21 are reacted by the stabilization pin 43 so that the spring arms 38 can apply high contact forces upon the lamp base 21 in order to reliably anchor the lamp base in the socket body 14. In case of the left stabilization bar 48 with respect to the drawing planes of FIGS. 6 and 7, the function of the stabilization pin 43 is performed by the ground conductor connection 16 which is an advantageous variant of this embodiment. It is also conceivable to provide a stabilization pin 43 also at this location and to facilitate the electrical contacting of the attachment ring 15 and of the ground conductor connection 16 in another manner.

It is evident from the descriptions provided supra that the changed arrangement of the retaining dip 39 saves installation space on the bottom side of the socket since only the socket contacts and connection contacts 17, 18 have to be arranged at this location. By the same token it is apparent that the adjusted arrangement of the retaining clip 39 provides an improved ventilation of the lamp base 21 by introducing the ventilation gap 23 into the bottom side of the socket which increases the service life of the lamp 12 in particular under the extreme temperatures that prevail in cooking appliances.

Integrating the retaining clip 39 into the attachment ring 15 in various generic sockets leads to a reduction in component count which simplifies fabrication and assembly.

Based on the drawing figures, various embodiments of the invention are conceivable. Thus, the attachment clamp 39 can also be inserted into the socket base 14 from above without forming part of the attachment ring 15. Then the base plate 46 of the attachment ring 15 is reduced in diameter and does not include all additional components like interlocking springs 30 and attachment arms 33. The base plate then only includes the spring arms 38 which do not have to be arranged at the base plate 46 by stabilization bars 48 but can be arranged thereon.

In an advantageous embodiment the retaining clip 39 can be broken down into several components. One of the stabilization bars 48 can support one spring arm 38 and the spring arms 38 are inserted into the slot receivers 42 and anchored therein in a positive form locking or friction locking manner without the additional components of the attachment ring 15 and also without the base plate 46. The advantageous novel arrangement of the retaining clip 39 is maintained, however the component count is not reduced.

Last not least, the retaining clip 39 can be integrated into the attachment ring 15 and the attachment ring 15 can be mounted as described supra. In a second embodiment the connection between the base plate 46 and the spring arms 38 can be separated, e.g. by separating the stabilization bars 48 from the base plate 46 which then have to be supported in the socket body 14 by positive form locking or friction locking. This further improves electrical safety, in particular when omitting a ground conductor connection 16.

The invention relates overall to a novel configuration of a lamp socket for a cooking appliance, in particular a G9 lamp socket as typically used in ovens, steam cookers, etc. microwaves.

REFERENCE NUMERALS AND DESIGNATIONS

10 cooking appliance light
11 light glass
12 lamp
13 lamp socket
14 socket body
15 attachment ring
16 ground conductor connection
17 socket contact
18 connection contact
19 stud
20 lamp cylinder

21 lamp base
22 base contact
23 ventilation gap
24 socket base
25 annular wall
26 mounting flange
27 receiving cavity
28 light collar
29 interlocking spring cut out
30 interlocking spring
31 insertion opening
32 groove
33 attachment arm
34 base receiver
35 face wall
36 transversal wall
37 spring cut out
38 spring arm
39 retaining clip
40 support bay
41 ground conductor receiver
42 slot receiver
43 stabilization pin
44 contact cavity
45 coding rib
46 base plate
47 center cut out
48 stabilization bar, retaining arm
49 fixing lug
50 fixing cavity
51 elasticity cut
52 socket rib
53 bayonet protrusion

What is claimed is:

1. A lamp socket for a cooking appliance light, the lamp socket, comprising:

a socket body;

a base receiver configured to receive a lamp base of a lamp and formed at a top side of the socket body;

connection contacts for external connection conductors of a voltage supply, the connection contacts arranged at a bottom side of the socket body;

an attachment ring configured to retain the lamp base in the base receiver;

two retaining arms integrally formed at the attachment ring;

two spring arms respectively arranged at the two retaining arms and forming a receiving gap for the lamp base between each other and respectively including a free spring arm end and a connected spring arm end respectively connected at each of the two retaining arms, wherein the two spring arms are arranged in the base receiver, wherein the two retaining arms are arranged proximal to the top side of the socket body, and wherein free ends of the spring arms are oriented towards the bottom side of the socket body and arranged in the base receiver, wherein the socket body forms an attachment contour at the top side of the socket body for the two retaining arms that fix the spring arm at the socket body.

2. The lamp socket according to claim 1, wherein the attachment contour is a slot receiver that is fabricated on the top side of the socket body in a direction towards the bottom side of the socket body, and wherein the slot receiver is arranged adjacent to the base receiver.

3. The lamp socket according to claim 1, wherein the attachment ring is fixed at the socket body and envelops the base receiver.

4. The lamp socket according to claim 3, wherein the socket body forms a lamp receiver at the top side of the socket body, and wherein the lamp receiver is enveloped by a wall of the socket body and a base of the lamp receiver forms the base receiver.

5. The lamp socket according to claim 3, wherein the attachment ring includes at least one retaining device for a light glass.

6. The lamp socket according to claim 5, wherein the retaining device includes an attachment arm oriented toward the top side of the socket body and a bayonet protrusion integrally formed at the attachment arm.

7. A lamp socket for a cooking appliance light, the lamp socket, comprising:

a socket body;

a base receiver configured to receive a lamp base of a lamp and formed at a top side of the socket body;

connection contacts for external connection conductors of a voltage supply, the connection contacts arranged at a bottom side of the socket body;

an attachment ring configured to retain the lamp base in the base receiver;

two retaining arms integrally formed at the attachment ring;

two spring arms respectively arranged at the two retaining arms and forming a receiving gap for the lamp base between each other and respectively including a free spring arm end and a connected spring arm end respectively connected at each of the two retaining arms, wherein the two spring arms are arranged in the base receiver, wherein the two retaining arms are arranged proximal to the top side of the socket body, and wherein free ends of the spring arms are oriented towards the bottom side of the socket body and arranged in the base receiver, wherein the attachment ring is fixed at the socket body and envelops the base receiver, wherein the socket body forms a lamp receiver at the top side of the socket body, wherein the lamp receiver is enveloped by a wall of the socket body and a base of the lamp receiver forms the base receiver, wherein the wall forms fixing cavities at an inner surface of the wall, and wherein fixing lugs of the attachment ring engage the fixing cavities.

8. The lamp socket according to claim 7, wherein the wall includes fixing lug cut outs, wherein the fixing lugs of the attachment ring reach through the fixing lug cut outs, wherein the wall forms a mounting flange, and wherein a cooking cavity wall is arrangeable between the fixing lugs and the mounting flange so that the cooking cavity wall supports the lamp socket.

* * * * *